United States Patent [19]

Ikeda et al.

[11] Patent Number: 4,553,865

[45] Date of Patent: Nov. 19, 1985

[54] INK-SUPPLIED WIRE DOT PRINTER

[75] Inventors: Yoshito Ikeda; Hitoshi Fujiwara; Yoshifumi Gomi; Masanao Matsuzawa; Yasuhito Hirashima, all of Shiojiri, Japan

[73] Assignee: Epson Corporation, Tokyo, Japan

[21] Appl. No.: 502,857

[22] Filed: Jun. 9, 1983

[30] Foreign Application Priority Data

Jun. 10, 1982 [JP] Japan ..... 57-99548

[51] Int. Cl.[4] ..... B41J 3/12

[52] U.S. Cl. ..... 400/124; 400/198; 400/470

[58] Field of Search ..... 400/119, 120, 124, 198, 400/470, 471, 471.1; 101/93.05; 346/140 R

[56] References Cited

U.S. PATENT DOCUMENTS

| | | | |
|---|---|---|---|
| 3,985,216 | 10/1976 | McIntosh | 400/120 |
| 3,999,190 | 12/1976 | Brown et al. | 346/140 R |
| 4,007,684 | 2/1977 | Takano et al. | 101/366 |
| 4,106,030 | 8/1978 | Hampton et al. | 346/140 R |
| 4,119,836 | 10/1978 | Motokawa | 101/365 X |
| 4,194,846 | 3/1980 | Zerillo | 400/124 |
| 4,199,675 | 4/1980 | Sharpless | 219/305 |
| 4,223,324 | 9/1980 | Yamamori et al. | 346/140 R |
| 4,251,824 | 2/1981 | Hara et al. | 346/140 R |
| 4,275,290 | 6/1981 | Cielo et al. | 219/216 |
| 4,275,402 | 6/1981 | Kern | 346/140 R |
| 4,296,421 | 10/1981 | Hara et al. | 346/140 R |
| 4,337,468 | 6/1982 | Mizuno | 346/1.1 |
| 4,400,102 | 8/1983 | Shiurila et al. | 400/471.1 X |

FOREIGN PATENT DOCUMENTS

| | | | |
|---|---|---|---|
| 42293 | 12/1981 | European Pat. Off. | 400/470 |

*Primary Examiner*—Paul T. Sewell

*Attorney, Agent, or Firm*—Blum Kaplan Friedman Silberman & Beran

[57] ABSTRACT

A wire dot printer comprises a plurality of wires for carrying ink respectively on the ends thereof, and ink applicator mechanism applying the ink to the wire, and an ink heater unit disposed adjacent to the wire ends for heating the ink to a controlled temperature level. The ink is applied to the side surfaces of the wires and is drawn to the wire ends by capillary attraction.

12 Claims, 13 Drawing Figures

FIG. 2(a)
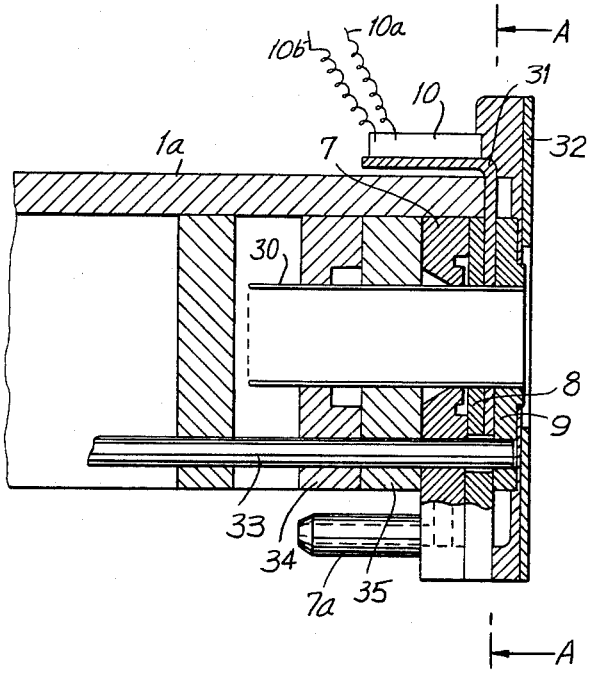
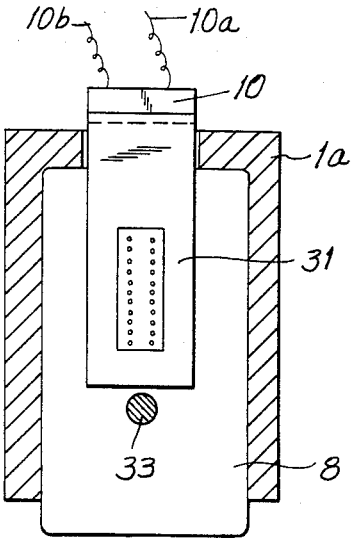
FIG. 2(c)
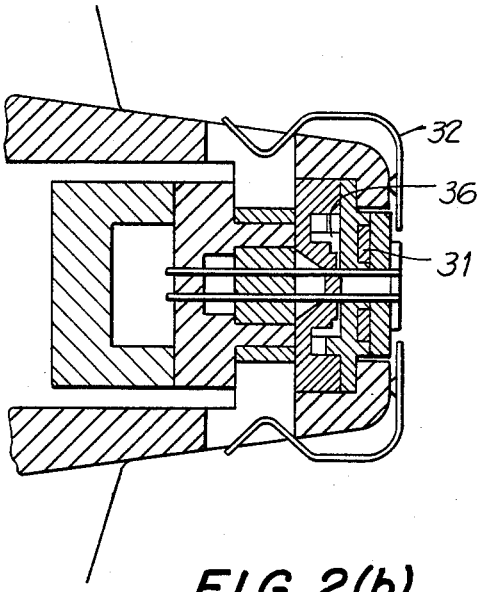
FIG. 2(b)

FIG. 6(a)
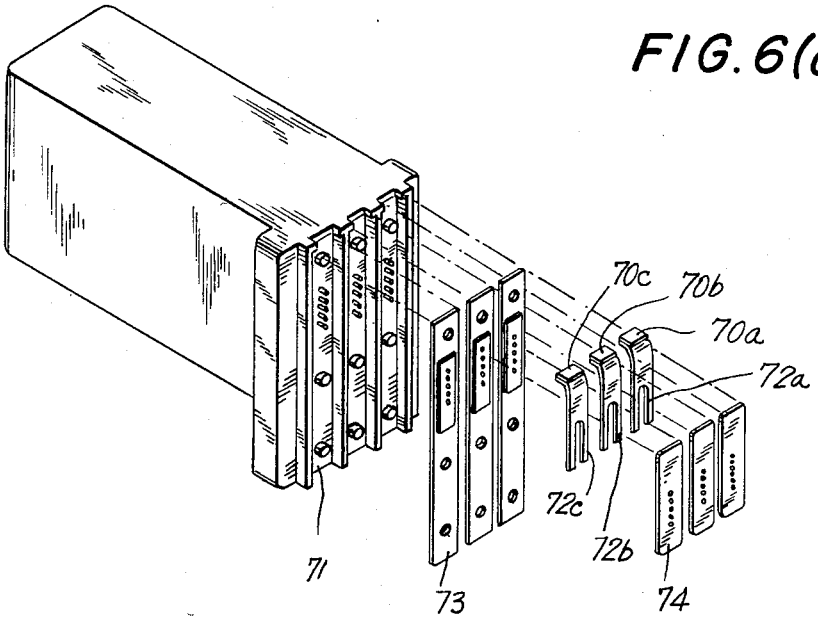
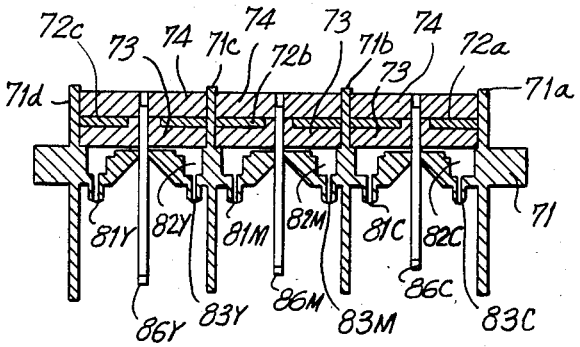
FIG. 6(b)

INK-SUPPLIED WIRE DOT PRINTER

BACKGROUND OF THE INVENTION

This invention relates generally to a dot printer of the type using wires to impact against a print medium and and more particularly, to a wire dot printer having an applicator mechanism for applying liquid ink to the ends of wires in a matrix to enable the wires to print characters and other symbols on the print medium, that is, paper without the use of an ink ribbon. On June 16, 1981, applicant filed a U.S patent application Ser. No. 06/274,322 for a wire dot printer which uses no ink ribbon but applies liquid ink directly to lateral surfaces of the wires and thence to the wire end by capillary action for enabling the wires to effect printing. The wire dot printer described in the earlier application is advantageous in that it does not have those problems which can be caused by the use of ink ribbons, and is capable of printing sharp characters and symbols with stability and uniform quality over an extended period of time. However, the quality of printing in the wire dot printer of the earlier application is affected by changes in temperature as such temperature changes affect the qualities and characteristics of liquid ink.

What is needed is a wire dot printer which operates without the use of ink ribbons and is unaffected in print quality by variations in temperature over an extended range.

SUMMARY OF THE INVENTION

Generally speaking, in accordance with the invention, a wire dot printer especially suitable for printing without the use of an ink ribbon over a wide range of ambient temperatures is provided. The invention represents an improvement of the above mentioned patent application and is concerned with avoidance of ink dispersal on impact of wire ends against a sheet of print paper at the time of printing. Also, the present invention reduces variations in printing density due to temperature changes, and prevents other problems from occurring. Construction of the wire dot printer is substantially similar to that described in the above mentioned patent application which is incorporated herein by reference. An ink heater unit is disposed adjacent to the ends of the multiplicity of wires which are used to impact and make dots on the print medium. The ink heater unit heats the ink applied to the wires by means of an ink applicator mechanism. Control of the ink temperature controls the ink viscosity and assures more uniform print quality and also permits the use of a high-viscosity ink without the problems normally associated with a normal viscosity ink.

Accordingly, it is an object of this invention to provide an improved, ribbonless wire dot printer which maintains the viscosity of the ink fed to the wires at a constant level, thereby effecting high quality printing with fixed printing density regardless of changes in temperature.

Another object of this invention is to provide an improved ribbonless wire dot printer which prevents ink from being dispersed or scattered during the printing process.

Still another object of the invention is to provide an improved ribbonless wire dot printer wherein ink remains unchanged in its characteristics after the printer has been out of service for an extended time period.

Yet another object of the invention is to provide an improved ribbonless wire dot printer which is capable of stable high quality printing for an extended period of time.

A still further object of the invention is to provide an improved ribbonless wire dot printer which allows for easy adjustment in hue in multicolor printing operation.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 2(*a*) is a partial cross-sectional view of an ink applicator mechanism on a print head in accordance with the invention;

FIG. 2(*b*) is a bottom view of the ink applicator mechanism of FIG. 2(*a*);

FIG. 2 (*c*) is a view taken along the line A—A of FIG. 2(*a*);

FIG. 3(*b*) is a view taken along line B—B of FIG. 3(*a*);

FIG. 4(*b*) is a view taken along line P—P of FIG. 4(*a*);

FIG 4(*c*) is a view taken along the line Q—Q of FIG. 4(*a*);

FIG. 6(*a*) is an exploded perspective view of an ink-supply and discharge guide in a wire dot print head in accordance with the invention using colored inks in which a heater structure is included;

FIG. 6(*b*) is a cross-sectional view of an ink applicator mechanism in the wire dot print head of FIG. 6(*a*)

DESCRIPTION OF THE PREFERRED EMBODIMENTS

Figure 1:
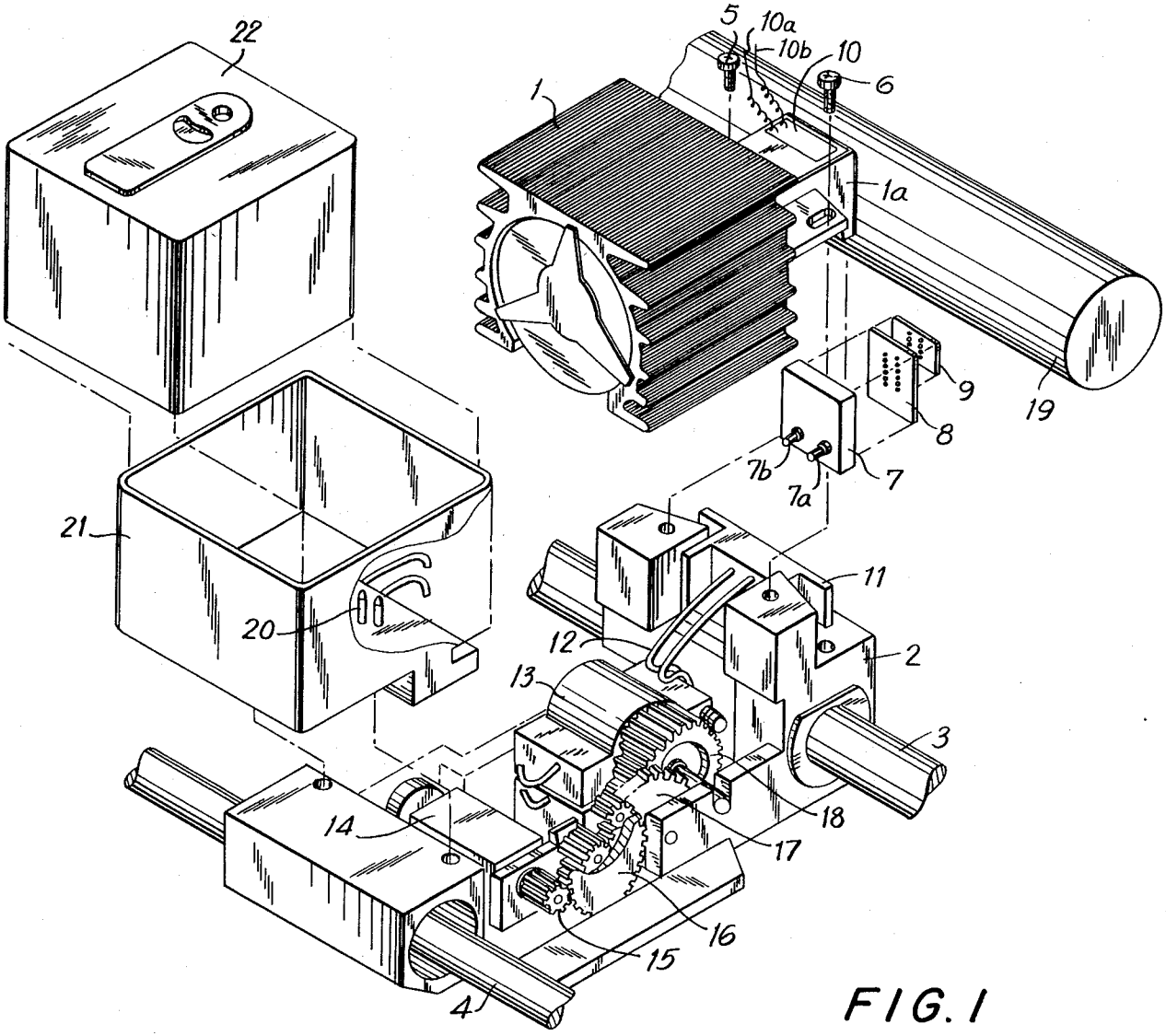
FIG. 1 is a partial exploded perspective view of an ink-supplied, that is, ribbonless, wire dot printer in accordance with the invention.

FIG. 1 shows in perspective an ink-supplied wire dot printer in accordance with the invention. The wire dot printer includes a dot print head (hereinafter referred to as a "head") 1 affixed to a carriage 2 by bolts 5, 6. The carriage 2 is guided for its movement by a pair of carriage guide shafts 3, 4 extending between a pair of opposite printer frame members (not shown). The carriage guide shafts 3,4 extend parallel to a platen 19 such that the carriage 2 can be reciprocably moved along the platen 19.

An ink supply and discharge guide 7 is mounted in a nosepiece 1*a* of the head 1 for guiding wires, and cooperate with a wire end guide 8 and an ink application plate 9 in defining an ink passage for controlling the application of ink to the wire ends. A heater 10 is secured to the nosepiece 1*a* and includes a heater element connected to a pair of lead wires 10*a*, 10*b* coupled to a power supply. A tube connector 11 has one end connected to pipes 7*a*, 7*b* of the ink supply and discharge guide 7 and the other end coupled to elastic tubes 12, made, for example, of silicone rubber, leading to an ink supply and discharge pump 13.

The ink supply and discharge pump 13 has a pump gear 18 that is rotated by a motor 14 through a train of gears 15, 16, 17 for supplying ink to the ink supply and discharge guide 7 and discharging ink from the ink supply and discharge guide 7. The ink supply and discharge pump 13 is of a known tube pump construction employing an elastic tube therein, and hence will not be described here in detail.

An ink tank 22 is fitted in a tank guide 21 having on its bottom a pair of upstanding hollow pipes 20 of metal engaging the ink tank 22 and serving as a coupling for supplying and discharging ink therethrough. In the illustrated arrangement, ink is supplied from the ink tank 22 through one of the hollow pipes 20, one of elastic tubes interconnecting the hollow pipes 20 and the ink supply and discharge pump 13, the ink supply and discharge pump 13, one of the elastic tubes 12, the tube connector 11, and the pipe 7*a* to the ink supply and discharge guide 7. Any excess ink in the head 1 is discharged from the ink supply and discharge guide 7 through the pipe 7*b*, the tube connector 11, the other elastic tube 12, the ink supply and discharge pump 13, the other elastic tube, and the other hollow pipe 20 back in the ink tank 22.

An ink applicator mechanism in the head 1 is illustrated in FIGS. 2(*a*), 2(*b*) and 2(*c*). A multiplicity of wires 30 are guided by wire guides 34,35. The ink passage and ink applicator mechanism are constituted jointly by the ink supply and discharge guide 7, the wire end guide 8, and the ink application plate 9, which also serve to guide the wires 30. The heater 10 is secured to a thermally conductive plate 31 made of a metal having good thermal conductivity and serves to heat the ink as supplied to the ink applicator mechanism. The thermally conductive plate 31 is shaped to surround the wires 30 and has a lower portion embedded in the wire end guide 8. The ink application plate 9 is pressed against the wire end guide 8 by a guide holder 32. The wire guides 34, 35 are properly positioned by a positioning rod 33 extending therethrough.

The ink applicator mechanism is now described in more detail. However, since the manner in which ink is applied to the wire ends is described in detail in U.S. patent application Ser. No. 06/274,322, the ink applicator mechanism is described here mainly with reference to the ink heater.

The ink supplied by the ink supply and discharge pump 13 is fed into the head 1 through the supply pipe 7*a* of the ink supply and discharge guide 7. The ink then flows across the wires 30 through a space, that is, ink passage 36 defined between the ink supply and discharge guide 7 and the wire end guide 8. The ink is drawn from the ink passage 36 under capillary attraction into gaps between the edges of holes in the wire guides and the wire 30, and also into clearances between the wire 30, and then is drawn and applied to the wire ends. Any excess ink is collected via the discharge pipe 7*b*. The thermally conductive plate 31 surrounds the wires 30 for heating the ink around the plate 31 to a predetermined temperature. Where the heater 10 is of a self-control type capable of controlling the ink temperature at a constant level, the heater 10 is connected directly to a power supply. In a case where the heater 10 comprises only a heater element, it is combined with a thermally sensitive device for temperature control in the conventional manner.

Figure 7:
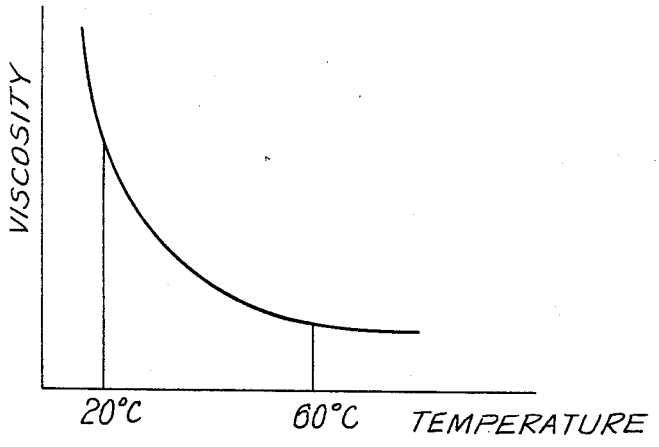
FIG. 7 is a graph illustrating the viscosity-temperature characteristics of a high viscosity ink used in the wire dot printer in accordance with the invention.

FIG. 7 illustrates the relationship between the viscosity and temperature of an ink put to use in the print head in accordance with the invention. The ink viscosity is in the order of a few hundred cp (centipoise) at normal temperature, that is nominally room temperature or 20 degrees C., and is in the range of 5 to 50 cp, optimum for printing, when heated to 60 to 80 degrees C.

In general, the ink viscosity increases and the ink flowability is reduced as the temperature is lowered. At lower temperatures, therefore, ink which is supplied to the wires tends to be insufficient, resulting in a lower printing density. For this reason, inks of a low viscosity such as 10 cp or below at normal temperature have conventionally been widely used. With low-viscosity inks, however, the amount of dye and solvent contained in the ink cannot be high due to the required low level of viscosity. To render the ink less viscous, a large proportion of water or other substance having a great tendency to evaporate is added to the ink. When such ink is left unused for a long period of time, the water content evaporates and hence the ink viscosity is increased. The result is that the ink fails to effect sharp printing, and no good and stable printing quality can be gained for a prolonged interval of time.

Printing operation is now described. In response to a printing command, ink is supplied to the head 1 by the ink supply and discharge pump 13. Substantially at the same time, the heater 10 is heated to increase the temperature of the ink around the thermally conductive plate 31. When the ink temperature reaches a prescribed level, the carriage 2 is actuated to start printing. During the printing process, the heater 10 is controlled to keep the temperature of the ink constant at the distal ends of the wires 30.

While the pump 13 has been described as being in the form of a tube pump, other types of pumps may be used such as for examples a diaphram-operated pump, a piston pump, a gear pump, and the like. The ink temperature is set up in the range which is not adversely affected by an increase in the temperature of the head and the ambient temperature during printing operation. The ink properties are selected so that they will be rendered optimum for the printing quality when heated.

Experiments conducted by the inventors indicated that the ink viscosity is correlated to the dispersion of the ink during printing operation. As ink viscosity goes higher, the ink is less dispersed or scattered around. With the ink viscosity being too high, however, the printing density is reduced, failing to effect clear printing, as described above. In an effort to meet the requirements for high ink density and increased printing density, the inventors carried out experiments and found that substantially no ink dispersal occurs and sharp printing is possible at ink viscosity ranging from 5 to 50 cp.

Comparison was made between a first printing operation in which no ink heater was used with an ink having a viscosity of 5–50 cp at normal temperature (hereinafter referred to as "low-viscosity ink") and a second printing operation in which the ink heater was used with an ink of 5–50 cp at 60–80 degrees C. (hereinafter referred to as "high-viscosity ink"). In this comparison, the low-viscosity ink was scattered around in a large amount in the printing operation, and substantially no ink dispersal was occasioned by the high-viscosity ink. One reason for this is considered to be due to the fact that with the high-viscosity ink, the temperature of the ink quickly drops and hence the ink viscosity is increased while the wires are being moved through the air, resulting in substantially no ink dispersal.

In accordance with the invention, the high-viscosity ink which is of a few hundred cp at normal temperature is heated by the ink heater during a printing process to keep the ink viscosity in the range of from 5 to 50 cp. This maintains the ink viscosity constant in the printing operation, thereby stabilizing the printing density, reducing ink scattering and improving the printing quality. The high-viscosity ink contains no water or other substance which can easily evaporate, but a solvent such as polyethyleneglycol, glycerine or the like, and therefore is highly resistant to evaporation. This high-viscosity ink assures stable printing quality even after the ink has been left unused for a long period of time. Since it is not necessary to reduce the ink viscosity, the amount of dye and a solvent therefor ink can be increased for a higher printing density.

Figure 3A:
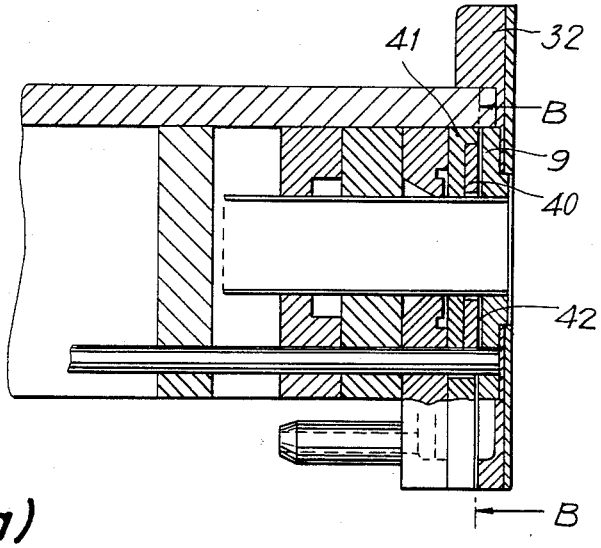
FIG. 3(*a*) is a view similar to FIG. 2(*a*) of an alternative embodiment of an ink-supplied wire dot printer in accordance with the invention.
Figure 3B:
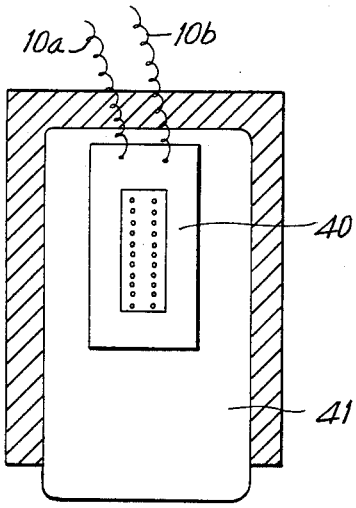

FIG. 3 shows an ink heater in accordance with another embodiment of the invention. A heater 40 is directly embedded in a wire end guide 41 and protected by a heater protection member 42. The heater 40 is disposed adjacent to the ends of the wires 30 where ink is applied. This arrangement allows a reduction of the time required to heat the ink and simplifies the overall ink applicator mechanism. Alternatively, a heating material may be deposited by way of evaporation on the wire end guide 41 and other wire guides or by constructing these wire guides with high conductivity plastic material in which carbon and the like are added to the plastic so that these guides per se serve as an ink heater. In the illustrated embodiment, the ink heater 40 is secured to the wire end guide 41. However, the ink heater 40 may be attached to any other structural member for heating the ends of the wires 30 to which ink is applied.

The ink heater 40 may be located anywhere in the ink supply system between the ink tank and the ink applicator mechanism. However, it is most effective to locate the ink heater 40 in the vicinity of the printing ends of the wires 30.

As described above, an ink print head constructed in accordance with the invention contributes substantially to the prevention of ink dispersal, improved printing quality, and increased printing stability for a long time, tasks which it has been most difficult for conventional ink-supplied dot printers to perform.

Figure 4B:
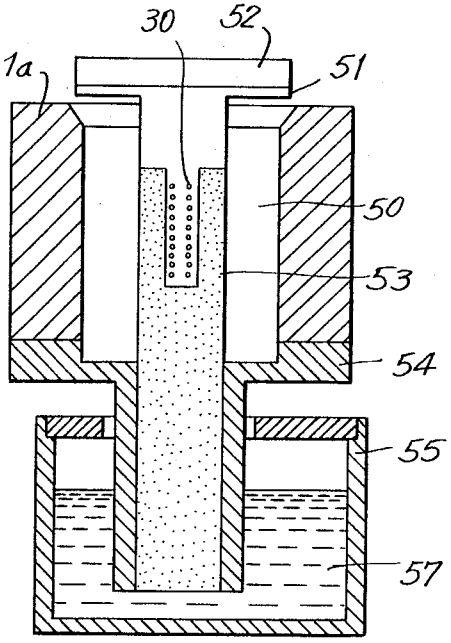
FIG. 4(*a*) is a view similar to FIG. 2(*a*) of another alternative embodiment of an ink-supplied wire dot printer in accordance with the invention.
Figure 4A:
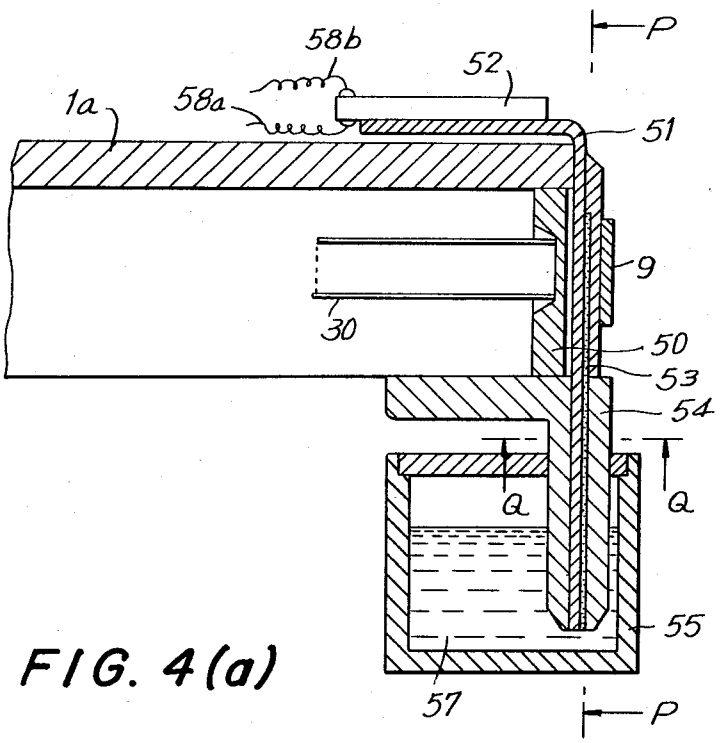
Figure 4C:
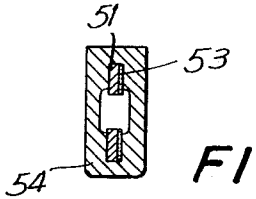

A heater construction with an ink supply function which employs high-viscosity ink in another embodiment in accordance with the invention described with reference to FIGS. 4(*a*), 4(*b*) and 4(*c*). A reference numeral 50 denotes a wire end guide. A thermally conductive plate 51 and a heater 52 secured to the plate 51, jointly comprise a heater unit. An ink supply member 53 is disposed in intimate contact with the heater unit and comprises a mass of fibers, a body of porous plastics, a mesh of stainless steel or other metal, or any other construction having minute interstices, which provide capillary attraction. The thermally conductive plate 51 and the ink supply member 53 are fixed in position by a fixture plate 54 having a lower portion extending into an ink tank 55, wherein the thermally conductive plate 51 and the ink supply member 53 are dipped in high-viscosity ink 57 having a few hundred cp. The fixture plate 54 is secured to a nosepiece 1*a* so that the fixture plate 54 is joined firmly to the head 1.

An ink applicator mechanism is comprised of the wire end guide 50, the ink supply member 53 and the ink application plate 9, the ink tank being located adjacent to the ink applicator mechanism.

Printing operation of the ink applicator mechanism is now described. When the heater 52 is energized in response to a printing command, the ink supply member 53 is heated to an elevated temperature by the thermally conductive plate 51. The ink 57 as it is in contact with the ink supply member 53 is heated until its viscosity is lowered and its flowability is increased. The ink supply member 53 draws the ink which is rendered more flowable under capillary attraction into the ink applicator mechanism at a rate commensurate with the printing speed.

The ink supply member 53 may be comprised of any construction capable of providing capillary attraction, such as the materials listed above. The ink 57, which is drawn into the ink applicator mechanism, is applied to the wire ends for printing operation, as with the foregoing embodiment. The heater unit thus heats the high-viscosity ink until the latter has a lowered viscosity and increased flowability, which allows the ink to be supplied through the ink supply member 53 at an accelerated rate under the capillary attraction thereof. The higher the temperature to which the ink 57 is heated, the lower the flowability of the ink 57 may be at normal temperature. However, the ink viscosity should be selected for highest printing quality. With the illustrated arrangement, the ink supply member 53 extends between the ink 57 in the ink tank 55 and the ink applicator mechanism. The ink 57 can be brought into the condition best suited for the printing operation from the instant the ink 57 is heated, and can be put to use for printing in such best condition.

The flowability of the ink 57 can be controlled by varying the temperature of the heater unit to change the amount of ink staying at the end of the ink applicator mechanism for thereby controlling the printing density.

In accordance with the invention, as described above, the ink-supplied wire dot printer includes an ink applicator mechanism, and ink tank disposed in the vicinity of the ink applicator mechanism, the ink applicator mechanism having an ink supply member providing capillary attraction for supplying ink from the ink tank to the wire ends, and a heater unit for heating the ink supply member. This arrangement allows high-viscosity ink to be supplied without using a pump, resulting in a much simpler ink supply mechanism. As a modification, the ink supply member 53 may serve as a thermally conductive plate in the form of a sandwiched construction composed of a mesh of stainless steel or other metal or a metal plate having minute pores. Alternatively, the ink supply member 53 may comprise a mesh of metal having a high electric resistance such that it will be heated when an electric current is passed therethrough.

Figure 5:
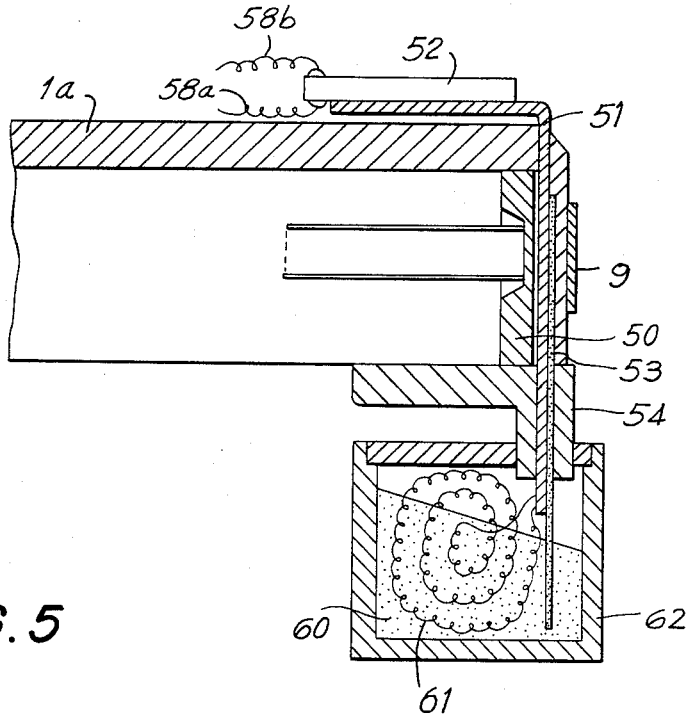
FIG. 5 is a cross sectional view of a ink-supply unit for supplying solid or semi-solid ink to a wire dot printer in accordance with the invention.

The high-viscosity ink has a viscosity of a few hundred cp in the foregoing embodiment. The ink, when heated by the heater unit to 60–80 degrees C., will have a viscosity optimum for printing, such as 5–50 cp.

Where the heater unit is employed, there is no limitation imposed on the viscosity of the ink at normal temperature. In certain applications, there may be employed a solid or semi-solid ink such as wax or vaseline in which dye or pigment is dissolved. FIG. 5 shows an ink supply member and an ink applicator for use with such a semi-solid or solid ink. A mass of semi-solid or solid ink (hereinafter referred to as "solid ink") 60 is contained in an ink casing 62. A heater unit member 61 is placed in the mass of solid ink 60 in coiled formation and is connected to an ink applicator mechanism. The ink is supplied to the ink applicator mechanism in the same manner as described above. Experiments conducted by the inventors showed that sufficient printing capability was achieved for good printing though the heater unit had to be heated to a higher temperature than that of the high-viscosity ink as described in the previous embodiments. No ink dispersal occurs even when an increased amount of ink is applied to the wires. The ink casing may be of a simpler construction as the solid ink does not leak through the ink casing.

When the solid ink is employed, therefore, ink will not be scattered around and a high printing quality can be maintained. The solid ink is quite easy to handle since it does not spill over or leak through the ink casing as does the liquid ink.

FIGS. 6(*a*) and 6(*b*) are illustrative of a wire dot print head using inks of different colors in which the principles of the present invention are incorporated. The wire dot print head employs inks of three primary colors, that is, yellow, magenta and cyan, which are indicated by Y, M and C, respectively. Inks Y, M, C are fed through ink supply ports 81Y, 81M, 81C and ink passages 82Y, 82M, 82C to ink collection ports 83Y, 83M, 83C, respectively. The ink passages 82Y, 82M, 82C are defined between an ink supply and discharge guide 71 and wire end guides 73. Arrays of wires 86Y, 86M, 86C are mounted in their respective ink applicator mechanisms and associated with ink application guides 74 which assure stable application of the inks to the wires. The manner in which the inks are applied to the wires is described in detail in the U.S. patent application Ser. No. 06/274,322, filed by the same applicant, and will not be described here. The ink applicator mechanisms are separated from each other by walls 71*a*, 71*b*, 71*c*, 71*d* extending tubularly in a to-and-fro direction for preventing the inks in the ink applicator mechanisms from being mixed together. The inks Y,M and C are supplied from independent ink tanks, respectively, through their respective supply tubes to the ink supply and discharge guide 71, the distal end of the print head, and any excess inks are returned to and collected by the ink tanks.

Heaters 70*a*, 70*b*, 70*c* and thermally conductive plates 72*a*, 72*b*, 72*c* combined therewith are independently provided respectively for the three colored inks. The thermally conductive plates 72*a*, 72*b*, 72*c* are embedded respectively in the wire end guides 73.

In the embodiments of FIGS. 1 through 5, the ink application structures for applying single-color ink to the wires have been described. The wire dot printer in accordance with the invention is capable of high-quality printing and can be fabricated less costly where no pump is employed. In addition to these advantages, the wire dot printer employing colored inks can adjust hues of printed characters and symbols. More specifically, the inks of different colors respectively in the spaces between the wire end guides 73 and the ink supply and discharge guide 71 can be controlled in their temperature independently by the heaters 70*a*, 70*b*, 70*c*. The variable heater temperatures can then control the flowability of the inks to thereby change the amounts of inks retained in the ink applicator mechanisms. In the embodiment employing the inks of three primary colors Y, M, C, the color red can be realized by adding Y and M, the color blue by adding M and C, the color green by adding C and Y, and the color black by adding Y,M and C when the amounts of inks of the respective three colors applied to the respective wires are equal.

When the amounts of the inks are varied by controlling the heater temperatures, other colors can be printed. For example, where inks Y and M are added in different quantities, printing can be effected in a color tinted with the color of the ink supplied in a larger amount. Therefore, by feeding the inks of three primary colors in different quantities, hues of printed characters or symbols can be corrected through control of the heater temperatures without modifying the ink applicator mechanisms. Since the color inks contain different dyes, they cannot be the same in properties. It is possible with the present invention to adjust the heater temperatures for compensating for the differences in the properties of the inks used while the ink applicator mechanisms for the inks remain physically identical to each other.

The heater arrangement of the present invention can thus effect high-quality colored printing and make simple hue adjustments.

While the color print head has been described as using inks of three primary colors, the present invention is also applicable to a color print head for use with four kinds of inks of three primary colors and black. As an alternative, the heaters 70*a*, 70*b*, 70*c* may be of an integral construction where the ink application structures and the ink properties are fully in a stabilized condition. This alternative arrangement is capable of uniformly controlling the printing density for each color as is the previous ink application construction using monochromatic ink.

With the arrangement of the present invention, as described above, high-viscosity ink can be maintained by an ink heater at a constant viscosity for high-quality printing. The high-viscosity ink has the advantage of stable ink characteristics retained over a long period of time. A pumpless ink supply structure can be realized by combining an ink supply member capable of capillary attraction and the ink heater. When incorporated in a color print head, the ink heater can make hue adjustments. Solid ink can also be employed by the present invention to effect printing.

Accordingly, the print head in accordance with the invention is effective in solving the technical problems which conventional ink-supplied wire dot printers have suffered, and enables such printers to perform high-quality printing.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A wire dot printer comprising:

a plurality of wires, each wire having an end for carrying ink thereon and for impacting a print medium for printing thereon;

a plurality of ink applicator mechanisms each containing a separate ink for applying said separate ink respectively to said wire ends, said wires being divided into groups, each of said groups being positioned for receiving a separate ink from one said ink applicator mechanism respectively; and ink heater means disposed adjacent to said wire ends for heating said ink, said ink heater means including a plurality of independent heaters, each said heater being associated respectively with one of said ink applicator mechanisms, each said heater being separately controlled so that the temperature of each said heater can be independently controlled whereby the viscosity of each separate ink can be separately controlled.

2. A wire dot printer as claimed in claim 1, wherein said heater means includes a separate wire guide member for each group of wires for guiding said wires.

3. A wire dot printer as claimed in claim 1, wherein each said independent heater separately controls the temperature of said respective separate ink within prescribed limits.

4. A wire dot printer as claimed in claim 1, wherein said ink applicator mechanism applies said ink to the lateral surfaces of said wires near said ends, said ink being drawn to said ends by capillary attraction.

5. A wire dot printer as claimed in claim 1, wherein at least one said ink applicator mechanism applies to the associated wires ink of a different color from the ink applied by another said ink applicator mechanism.

6. A wire dot printer comprising:

at least one wire having an end for carrying flowable ink thereon and for impacting a print medium for printing thereon;

an ink applicator mechanism for applying said ink to said wire end;

an ink tank disposed adjacent to said ink applicator mechanism for containing an ink having a high viscosity therein;

an ink supply member for supplying ink from said ink tank to said ink applicator mechanism, said ink supply member operating by capillary attraction; and heater means for heating said ink supply member so that the viscosity of said ink is lowered to a state where it is sufficiently flowable to be applied to said wire end by said ink applicator mechanism.

7. A wire dot printer as claimed in claim 6, wherein said ink supply member is electrically conductive, said ink supply member generating heat when conducting an electrical current.

8. A wire dot printer as claimed in claim 6, wherein said ink supply member has a high thermal conductivity.

9. A wire dot printer as claimed in claim 6, wherein one end of said heater means extends into said ink tank.

10. A wire dot printer as claimed in claim 6, wherein said ink is at least a semi-solid at normal temperature.

11. A wire dot printer as claimed in claim 6, wherein said heater means is adapted for controlling the temperature of said ink supply member.

12. A wire dot printer as claimed in claim 6, wherein said ink applicator mechanism applies said ink to the lateral surface of said at least one wire near said end thereof, said ink being drawn to said end by capillary attraction.

* * * * *